United States Patent [19]

Lechner et al.

[11] Patent Number: 4,688,620

[45] Date of Patent: Aug. 25, 1987

[54] CURTAIN TAPE

[76] Inventors: Helmut Lechner, Forellenweg 1, 3590 Bad WildungenWega; Wilhelm Roller, Delaustr. 13, 7903 Laichingen 4, both of Fed. Rep. of Germany

[21] Appl. No.: 849,358

[22] Filed: Apr. 7, 1986

Related U.S. Application Data

[63] Continuation of Ser. No. 544,612, Oct. 24, 1983, abandoned.

[30] Foreign Application Priority Data

Oct. 28, 1982 [DE] Fed. Rep. of Germany ..... 3239973

[51] Int. Cl.[4] ..... A47H 13/14

[52] U.S. Cl. ..... 160/348; 16/87.2

[58] Field of Search ..... 160/330, 348, 345, 340, 160/341; 16/87.2, 87.4 R, 87.4 W, 87.6, 87.8, 93 D, 94 D, 95 D, 96 D

[56] References Cited

U.S. PATENT DOCUMENTS

| | | | |
|---|---|---|---|
| 2,599,429 | 6/1952 | Bernhard | 160/348 |
| 2,779,405 | 1/1957 | Hess | 160/348 |
| 2,854,073 | 9/1958 | Ramm | 160/348 |
| 3,013,654 | 12/1961 | Hoff | 16/87.2 |
| 3,214,788 | 11/1965 | Poultney | 16/87.2 |

FOREIGN PATENT DOCUMENTS

| | | | |
|---|---|---|---|
| 1206126 | 10/1963 | Fed. Rep. of Germany | 16/87.4 R |

*Primary Examiner*—Robert W. Gibson, Jr.
*Attorney, Agent, or Firm*—Max Fogiel

[57] ABSTRACT

A curtain-tape, for hanging a curtain and forming fan-pleats, comprises a tape adapted to be attached, more particularly sewn, along one edge of the curtain, and elements secured thereto at predetermined intervals or alternating intervals and adapted to be joined together to form fan-pleats. In order to make up the elements, slides, rollers or the like, known per se, are divided into individual slide- or roller-elements. Several such slide- or roller-elements are, in turn, adapted to be connected together, thus forming a fan-pleat, into a group of slide- or roller-elements.

13 Claims, 27 Drawing Figures

CURTAIN TAPE

This application is a continuation of application Ser. No. 544,612 filed 10-24-83, now abandoned.

The invention relates to a curtain-tape. A curtain-tape is sewn, in known fashion, to the upper edge of a curtain and serves to place the curtain in folds. The tape also provides points of application for slides or rollers by means of which the curtain is suspended displaceably in or on a track and is thus guided.

A curtain-tape of the type described at the beginning hereof is known from Germain Utility Model 1,963,045. Provided in the vicinity of the tape, and secured thereto, are separate elements adapted to be connected together to form fan-pleats. These elements are in the form of pressure- or adhesion-strips arranged directly upon the tape. The strips or plates form respectively male and female elements and are adapted to be connected in pairs with each other or with an additional holding plate. The pressure- or adhesion-strips may also be in the form of a row of snap-fasteners. Thus separate elements in the vicinity of the tape are connected thereto and, although they make it possible to place the curtain in folds, they have the disadvantage of wearing out the strip. If individual pressure- or adhesion-strips are connected together, i.e. without the use of an additional holding plate, there is produced a meander-pattern folded with fan-pleats projecting on each side in the direction of travel of the curtain. If, however, an additional holding plate is used, fan-pleats can be produced which project on one side only. This additional holding plate, or even individual pressure- or adhesion-strips, or pairs of adhesion-strips may be equipped with hangers, rollers, or the like. To this end, one end of all or some of the holding plates may be provided with holes, hangers, or the like to which conventional holders for rollers, rings, or the like can be attached. This known curtain-tape thus provides separate male and female holding strips, in the vicinity of the curtain-tape, which may then be connected to, or equipped with, slides, rollers, or the like which are in any case necessary in addition to the adhesion-strips. The meander-pattern fan-pleating, obtainable with the known curtain-tape has the disadvantage that the pleats project from both sides. Pleats facing the adjacent wall may cause problems, if the curtain-tracks is already, or must be, fitted relatively close to the wall. The pressure- or adhesion-strips, or the snap-fastener parts themselves are arranged in the vicinity of the curtain-tape, i.e. they wear out at the folds, so that the fan-pleats acquire an unattractive, relatively large width. Furthermore, these elements perform no suspending or carrying function. Instead, it is necessary for individual pressure- or adhesion-plates, or pairs of adhesion-plates, to be equipped with hangers, rollers, or the like. It thus becomes necessary to provide, in addition to the elements, slides or rollers which can be fitted to the pressure- or adhesion-strips. It is quite possible for the slides or rollers, which are awkward to fit, to become detached from the curtain-tape or the elements, especially during washing, in which case they must be refitted. Nor does the known curtain-tape permit any great variation in folding, i.e. the number of adjacent pleats is predetermined by the arrangement and design of the holding strips. If an additional holding strip is used, it may be equipped with a slide or roller. These holding plates again can also become detached and lost, but they may perform a certain supporting function if fitted with a hook or the like.

A quite similar state of the art is disclosed in U.S. Pat. No. 3,132,686. Here again, use is made of a curtain-tape comprising individual male elements in the vicinity of the tape. In conjunction with a separate holding element, comprising female connecting parts, it is possible to form and set pleats projecting from one side only, as mentioned hereinbefore. The additional holding element may be equipped with a hook for hanging and may thus also perform a certain supporting function. The curtain-tape itself consists of a strip of synthetic material comprising weak locations at predetermined intervals for folding over or making pleats. Again this design of curtain-tape wears out during folding as a result of the arrangement of elements in the vicinity thereof, and a bunch of fan-pleats therefore extends for some considerable distance in the direction of travel of the curtain. In addition to the elements provided in the vicinity of the curtain-tape, slides or rollers must in any case be provided if a curtain thus equipped is to suspended from a track, for example. Again in the case of this known design, the number of fan-pleats is predetermined and cannot therefore be varied.

Also known is a curtain-tape which is also known as a pleating tape and is usually woven from a textile material or from synthetic yarn, and carries one or more crimped yarns in alternating areas. Thus areas of intimate intertwining between crimped yarns off a strip alternate with areas where the crimped yarns lie more exposed. These exposed areas preform the folds in a fan-pleat.

When the crimped yarns are drawn together, the folds for the fan-pleats are formed in the strip and thus in the curtain. However, it is not only these areas that are drawn together, but also the areas of intimate interweaving between crimped yarns and strip, i.e. those areas which will later form the spaces between adjacent fan-pleats. After the crimped yarns have been drawn together, therefore, it becomes necessary to space the individual fan-pleats again. At this time, the crimped yarns, previously drawn well out of the strip, are drawn back again to some extent. This dividing up and spacing of the fan-pleats is time-consuming and is dependent upon the skill of the operator. What is an advantage is that the location and folding of the pleats is already predetermined, since this preparation of the curtain, and folding and spacing of the pleats is costly and troublesome. Thereafter, the slides or rollers still have to be hooked into the suspension loops in the folding strip, before the curtain can be hung.

Based upon a curtain-tape of the kind described at the beginning hereof, it is the purpose of the invention to provide a novel curtain-tape which can be applied to curtains without too much effort and skill, and with which the curtain can be hung with attractive pleats. Preparatory work on the curtain, prior to hanging, is thus substantially simplified. The fan-pleats are to project on one side only, with individual pleats occurring automatically in uniformly reproducible fold-lengths and the distance between successive pleats being at all times constant.

The invention may be defined in that the hitherto-known slides or roller-rings are divided into individual separate slide- or roller-elements which, as a rule, are smaller than known slides or roller-rings. These elements are secured to the strip at accurately spaced intervals and cannot become detached when the curtains are washed. The invention is therefore not initially concerned with the additionally necessary pressure- or adhesion-strips, but uses as its starting point the slides or rollers which are in any case present and are also necessary, dividing them into individual elements and then making them connectable to each other or connectable by means of additional elements, and thus producing groups of slide- or roller-elements which assume the functions of hitherto-known slides or rollers. When the elements are joined together, a pleat is produced. Each fan-pleat thus has a certain number of folds which is less by one than the number of slide-or roller-elements brought together. The arrangement and design of the slide- or roller-elements does not, in many cases, determine the number of folds which the fan-pleat must or should have, and there is often a wide variation in width. The invention may be applied both to internal and external tracks and may be adapted to a very wide variety of tracks and slide- or roller-systems. Since the slide- or roller-elements cannot be detached from the strip, there is no hooking of slides or roller-rings into loops on the curtain-tape. The strip also needs no loops and is thus simpler to produce. Moreover, the distances between adjacent slide- or roller-elements is accurate and reproducible. This results in extremely accurate folding in the vicinity of each fan-pleat and from fan-pleat to fan-pleat to fan-pleat. With a curtain-tape of this kind, perfectly hung curtains are possible without effort. Depending upon the design of the curtain-tape, the pleats may be adapted to the requirements of taste. As a rule, the slide- or roller-elements will be applied to the strip in such a manner that the fans of the pleats project only from one side, i.e. from the room-side. In this way, the back of the curtain, which faces the window, presents no suspension problems.

According to the different forms of attachment, a firm connection between the slide- or roller-elements and the strip is achieved, so that normal handling, like washing of the curtains, does not cause the slide- or roller-elements to become detached from the strip. On the other hand, a slide-element may always be removed from the strip with pliers or scissors, for example for adapting the edge-area. If the strip has preformed fold-locations, the direction at each fold-over of the fan-pleats is also predetermined, thus providing assistance in assembling the slide- or roller-elements to the groups of slide- or roller-elements. These fold-locations may be in the form of weak spots in the strip or of specially weave-locations.

Another characteristic consists of a particularly simple and reasonable arrangement in that the uniting of individual slide- or roller-elements, in the vicinity of a fan-pleat, may be carried out effortlessly by hand, simply by inserting the male and female parts into each other, snapping them together, or joining them in some other way. It is also possible to use an adhesive or a solvent for the synthetic material from which the slide- or roller-elements are usually made. These joints between the elements may be releasable or, better still permanent, since in this way they are not destroyed when the curtains are washed, for example. In the case of a point-symmetrical design, a snap-fastener-type connection is provided between the elements. If the design of the connecting parts is linear, a linear groove is provided on the one hand and a linear rib on the other hand, and these engage one in the other in the connected condition. Another characteristic is that it also prevents rotation and displacement between the united slide- or roller-elements. A straight section of this kind may be roof-shaped, for example.

Another feature of the present invention is that the slide- or roller-elements may be made particularly small, so that even a pleat consisting of a relatively large number of folds does not wear very much. In this case, each slide- or roller-element bridges the inner or outer track and thus performs a supporting function. Where several such elements are united, the length of the group of slide- or roller-element will not increase unduly. It is thus possible for a group of four or five slide-elements of this kind to be of an order of magnitude no greater than that of conventional slides.

Another feature of the present invention is its use when the slide- or roller-elements are not connected directly together and an additional connecting element is provided. These connecting elements are first fitted to the slide- or roller-elements during the joining together or the forming of the fan-pleats and are then connected to the said slide- or roller-elements. The joint may also be by snap-fastener, by friction, or the use of an adhesive or the like. Detachable joints for the slide- or roller-elements may be in the form of bayonet or plug-in fasteners designed and arranged in such a manner that they cannot be disconnected when the curtain is drawn for example, because of the tension on the curtain-tape, but can be intentionally disconnected by a combined turning and sliding movement, or by a simple sliding movement in a plane at right angles to the pull.

The connecting web, projecting downwardly from the head of each slide- or roller-element, is made flat in the direction of travel, thus preventing the group of slide- or roller-elements on the inner track from rotating. The connecting web may be made U-shaped in the form of a loop. It may be relatively thin-walled and is thus very easily woven-in during the weaving process used to form the strip. In this case it is also possible for the slide- or roller-elements to be sewn to the strip. The sewing process, however, is in any case carried out during the production of the curtain-tape.

The invention is explained in greater detail in conjunction with the examples of embodiment illustrated in the drawing attached hereto, wherein.

Figure 4:
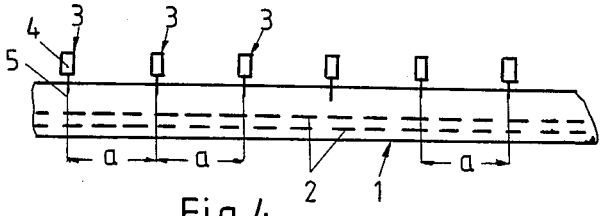
FIG. 4 is a diagrammatical representation of the joint between the slide- or roller-elements and the strip.
Figure 5A:
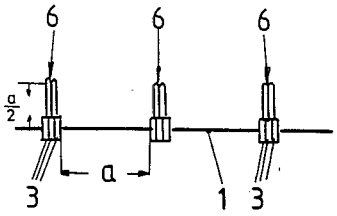
Figure 5B:
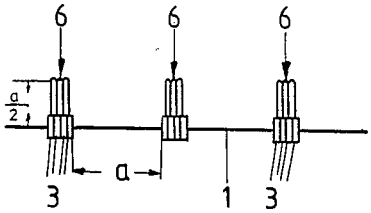
Figure 6:
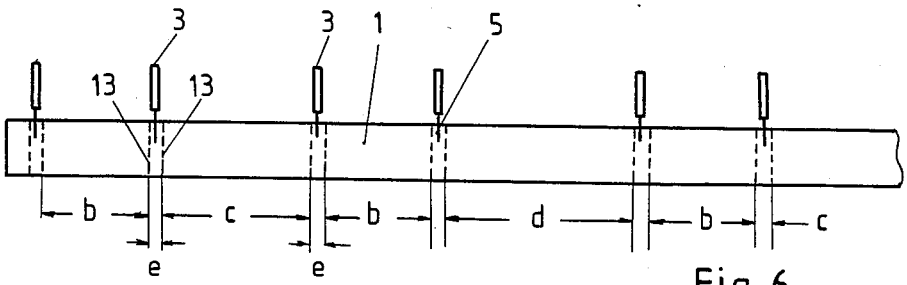
Figure 7:
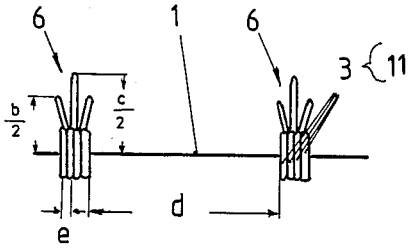
Figure 8A:
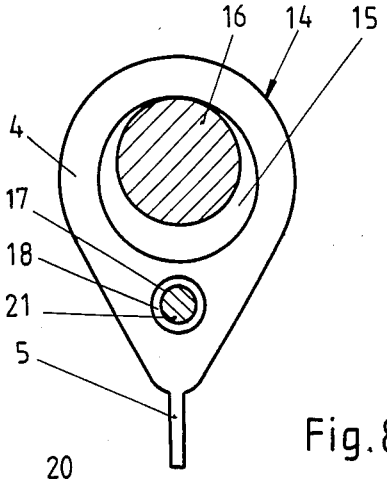
Figure 8B:
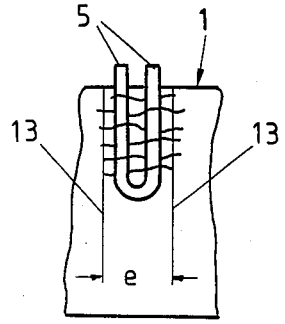
Figure 9:
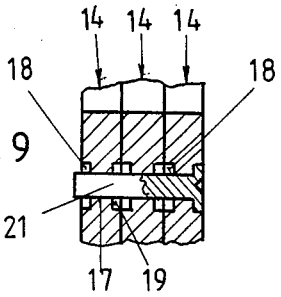
Figure 10:
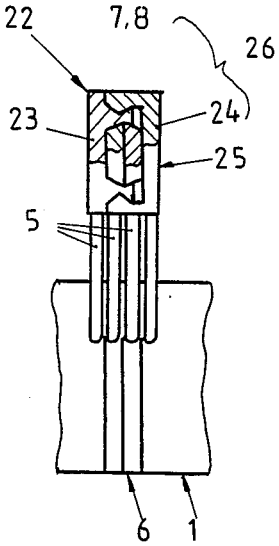
Figure 11:
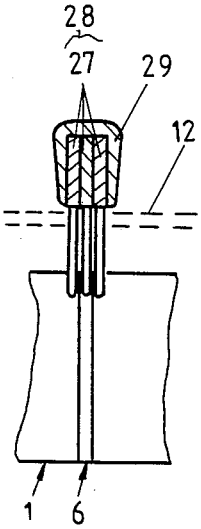
Figure 12:
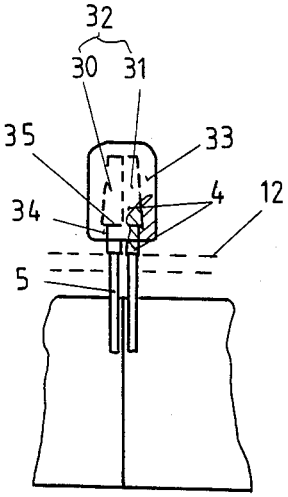
Figure 13:
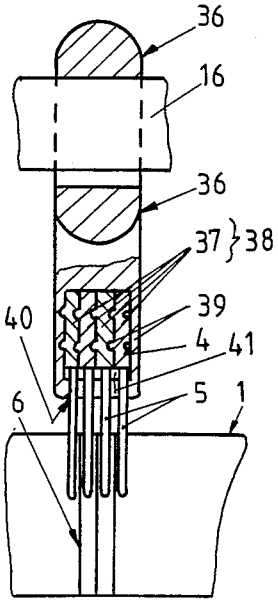
Figure 14:
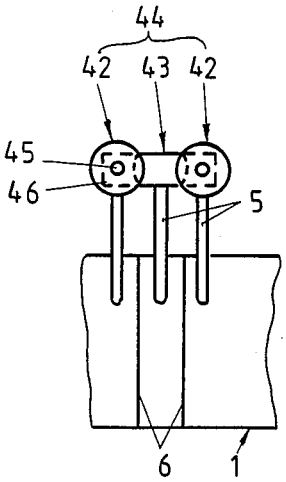
Figure 15:
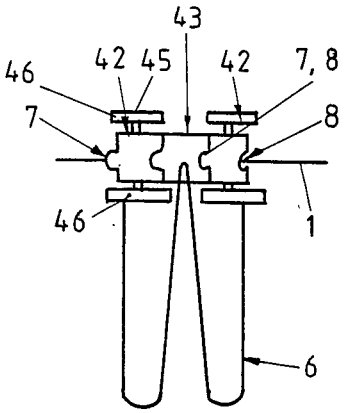
Figure 16:
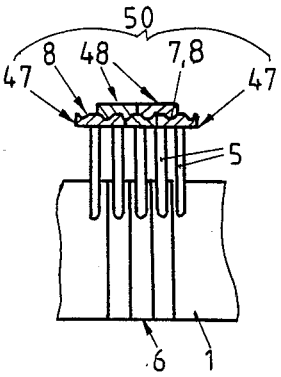
Figure 18:
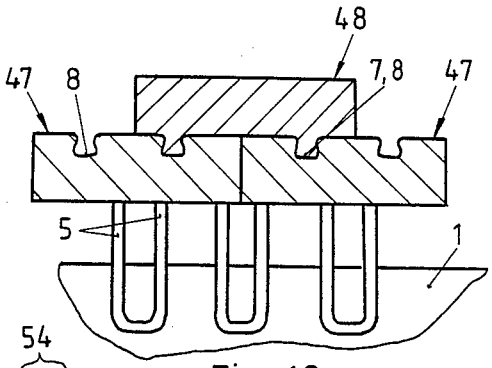
Figure 17:
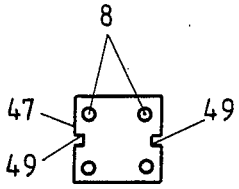
Figure 19:
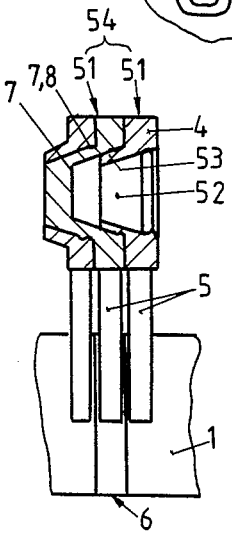
Figure 20:
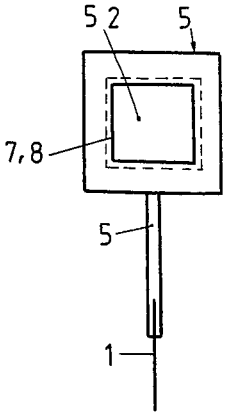
Figure 21:
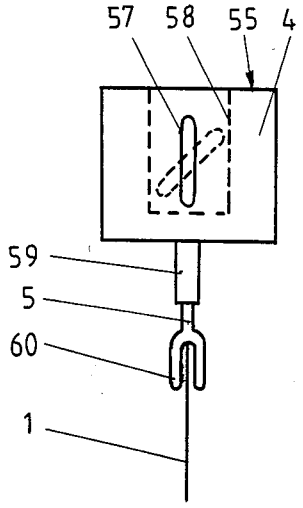
Figure 22:
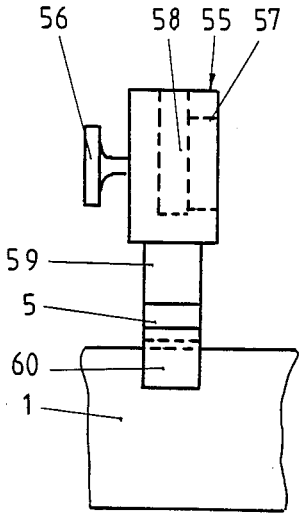
Figure 23:
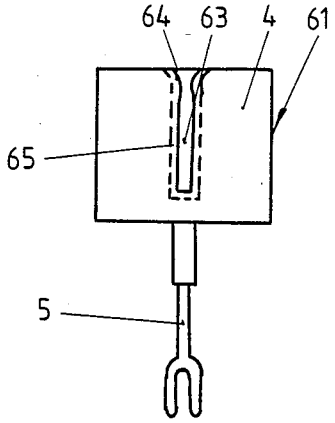
Figure 24:
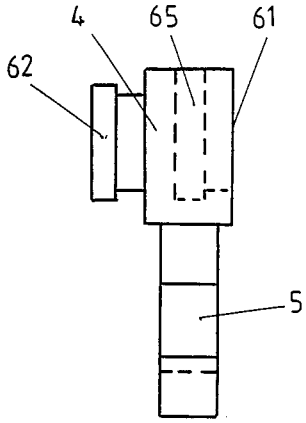
Figure 25:
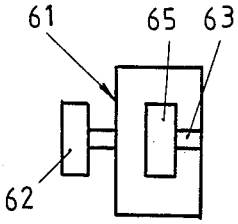

FIG. 5*a* shows a first way of forming fan-pleats from the curtain-tape according to FIG. 4;

FIG. 5*b* shows a second way of forming fan-pleats from the curtain-tape according to FIG. 4;

FIG. 6 is a diagrammatical representation of th curtain-tape with a special arrangement of the slide- and roller-elements;

FIG. 7 shows a first way of forming fan-pleats from the curtain-tape according to FIG. 6;

FIG. 8*a* is a view of a slide-element in the direction of travel;

FIG. 8*b* shows the joint between the slide-element according to FIG. 8*a* and the strip;

FIG. 9 is a cross-section through three slide-elements taken along line IX—IX in FIG. 8*a*, partly united into a slide-element group;

FIG. 10 is a representation, in part cross-section of a further possible union between slide-elements;

FIG. 11 shows the joining of slide-elements with a separate connecting element;

FIG. 12 shows the joining of two slide-elements with a further connecting element;

FIG. 13 is an embodiment of a sliding ring for a rod-track;

FIG. 14 is a side-elevation of another example of embodiment of the curtain-tape with roller-elements;

FIG. 15 is a plan view of the arrangement according to FIG. 14;

FIG. 16 is a view of the curtain-tape with a plurality of slide-elements;

FIG. 17 is a plan view of the head of a slide-element according to FIG. 16;

FIG. 18 is an enlarged view of the joint between three slide-elements;

FIG. 19 shows a further possible design for the curtain-tape equipped with slide-elements;

FIG. 20 is a side-elevation of the arrangement according to FIG. 19;

FIGS. 21 and 22 show another embodiment of curtain-tape;

FIGS. 23 to 25 show further embodiments.

For the sake of clarity, the curtain itself is not shown in any of the figures. All that is shown is a strip 1 made of a textile material or of synthetic yarn, usually by weaving. The dimensions of this strip are those of known fold-location strips. A strip of this kind is joined, in the flat condition (FIG. 4), by one or two lines of sewing 2, shown here is broken lines, to the upper edge of the curtain. Several slide-elements 3, all of them according to the example of embodiment illustrated in FIGS. 1 to 3, may be secured to strip 1 at equal intervals a, for example. Each slide-element 3 consists of a head 4 and a connecting web 5. The latter forms the joint with strip 1 to which it is permanently attached by spraying, gluing, welding, or in some other way, and can be separated from the strip only by a destructive process, for example by cutting it away.

Figure 1:
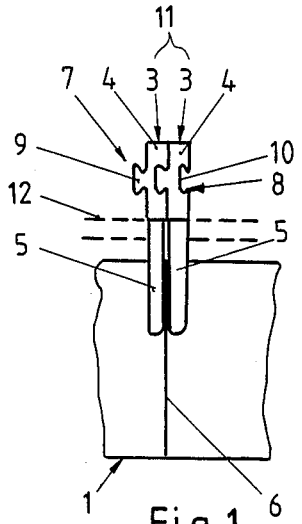
FIG. 1 is a view of a first embodiment of the curtain-tape at right angles to the direction of travel.
Figure 2:
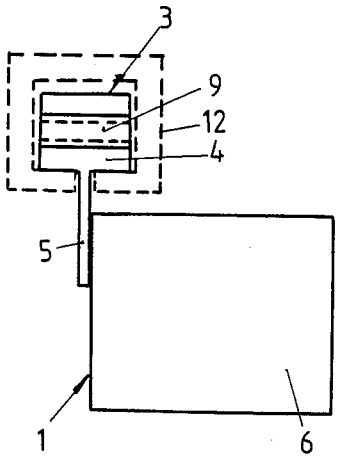
FIG. 2 is a view of the curtain-tape according to FIG. 1 in the direction of travel.
Figure 3:
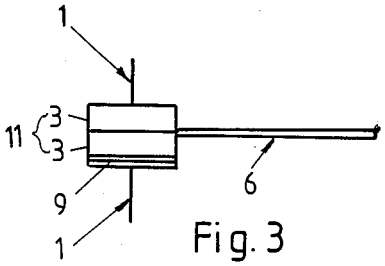
FIG. 3 is a plan view of the curtain-tape according to FIGS. 1 and 2.

In the embodiment according to FIGS. 1 to 3, two slide-elements 3 are joined together to form a fan-pleat 6 from a loop. This is achieved by a male connecting part 7 and a female connecting part 8 provided, in the manner shown, for each slide-element 3. Male connecting part 7 may consist of a continuous rib 9 with undercuts, while female connecting part 8 may consist of a matching groove 10, the parts extending transversely across head 4 on the front and rear sides thereof. Slide-elements 3 can thus be connected together either by a lateral sliding movement or by means of a snap-fastener-type closure. The slide-elements are disconnected by a sliding movement in the direction of the length of rib 9 or groove 10. It is obvious that more than two slide-elements can be connected to each other in this way, and fan-pleat 6 may therefore also consist of a plurality of loops. FIGS. 5*a* and 5*b* show two further ways of uniting a plurality of slide-elements on the curtain-tape according to FIG. 4. According to FIG. 5*a*, three slide-elements are joined together and fan-pleats 6 thus consist of two loops each which project from the plane of the strip by a distance a/2, whereas the distance between fan-pleats is a. By uniting individual slide-elements 3 into groups 11, fan-pleats having the desired number of loops are formed automatically. Slide-elements 3 can be united by a sliding or pressing process. An adhesive or a solvent can be additionally used to unite the slide-elements which are usually injection-moulded from synthetic material. This produces a permanent connection between elements 3 within a group of elements 11, but this is by no means undesirable since it makes it less likely that the group will be separated, for instance when the curtain is washed. In order to clarify the directions shown in FIGS. 1 and 2, a track 2, of the internal-track type, is shown in broken lines. It is to be understood that webs 5 do not project into strip 1 far enough to interfere with the sewing of the strip to the curtain, and that the joint is outside this sewing area. It is desirable for the joint to be made by ultrasonic welding. Whereas in the curtain-tape according to FIG. 4, slide-elements 3 are spaced at equal intervals, so that the fan-pleats may be made with the same or varying numbers of loops, FIG. 6 shows a very special design of curtain-tape in which four slide-elements 3 are joined together as shown in FIG. 7. In this, slide-elements 3 are arranged at different intervals b, c, d. The width of connecting web 5 is shown at e. Strip 1 comprises preformed fold-locations 13 which may also be in the form of weak spots. The strip thus has preformed folds which promote a back and forth meander pattern. It is to be understood that, here again, strip 1 is sewn flat to the curtain, as shown by line 2 in the embodiment according to FIG. 4. Slide-elements 3 are then united into groups 11 comprising a central loop of the dimension c/2 and a right-hand and left-hand connecting loop of the dimension b/2 in one fan-pleat in slide-element group 11. The distance between outer slide-elements 3, facing each other, of adjacent groups 11 is shown at d. FIG. 7 shows that the folds of fan-pleat 6 are particularly attractive and project very decoratively. Above all, the back of strip 1 facing the window is free from folds, so that the curtain can be drawn along very close to the wall without any danger of being caught up or being impeded.

FIGS. 8*a*, 8*b* and 9 illustrate a further embodiment. In this case, several annular slide-elements are provided, each comprising an opening 15 accommodating an approximately circular curtain rod 16 along which it can be pushed. Located in the lower part of head 4 of each slide-element is a hole 17 with countersinks 18 and 19 on each side. In order to form a group of slide-elements 20 (FIG. 9), a length of plastic wire of circular or square cross-section, constituting a separate connecting element 21, is passed through holes 17 in adjacent slide-elements 14 and is flanged at both ends by welding with the application of heat, or is welded to the material of the terminal slide-elements by pressing the material of connecting element 21 into countersinks 18, 19, as shown at one end in FIG. 9. It is to be understood that the length of connecting element 21 is determined by the union of three slide-elements 14. If groups containing a different number of slide-elements are formed, connecting element 21 will have to be longer or shorter. If a connecting element 21 of circular cross-section is used, slide-elements 14 can rotate slightly in relation to each other about the axis of the connecting element. On the other hand, if holes 17 and connecting element 21 are square, there will be no rotation. In this case, web 5 on head 4 of slide-element 14 is in the form of a loop (FIG. 8*b*), thus making it a simple matter to weave slide-element 14 in during production of strip 1. It is for this reason that individual threads of strip 1 are shown in FIG. 8*b*.

The design of the curtain-tape according to FIG. 10 is similar to that in FIG. 1, but the arrangement and design of slide-elements 22, 23, 24, 25 is different. The four elements are combined to form a group 26, which results in a fan-pleat with four loops. Inner slide-elements 23, 24 are first inserted into outer slide-elements 22, 25, the elements being joined together by male and female connecting parts 7, 8 between outer elements 22, 25. It is to be understood that, in the vicinity of head 4, slide-elements 22 and 25 must be pierced facing connecting webs 5, so that the webs can extend through elements 23 and 24. In this way, group 26 of slide-elements as a whole has dimensions of the order of magnitude of known slides or less. All drawings are to an enlarged scale, so that the details appear more clearly.

In the case of the embodiment according to FIG. 11, three slide-elements 27, which are in the form of flat, rectangular plates in the area of head 4, are combined to form a group 27, a separate connecting element 29, in the form of a clamp enclosing the three slide-elements 27. Connecting element 29 may be held in place by clamping friction. Heads 4 of the slide-elements may also be glued to each other and to the interior of the said connecting element. The lateral legs of connecting element 29 terminate slightly above the lower edge of heads 4 which form the surface which runs on track 12. Here again it is to be understood that different numbers of slide-elements 27 require connecting elements 29 of different dimensions.

FIG. 12 illustrates a very similar embodiment, except that use is made of wedge-shaped slide-elements 30, 31 combined to form a group 32 and connecting element 33 is hat-shaped and thus encloses heads 4 of the slide-elements on all sides. The connecting element has an undercut peripheral edge 34 in which a shoulder 35 in the vicinity of head 4 engages. The lower limit of head 4 here again forms the surface which slides upon track 12, shown in broken lines. Since group 32 comprises only two slide-elements 30, 31, fan-pleat 6 will naturally have only one loop.

In the embodiment according to FIG. 13, connecting element 36 accommodates four identical elements 37 combined to form a group 38, the connecting element being in the form of a ring which slides along curtain-rod 16. In this case, elements 37 do not act as slides, this function be assumed by connecting element 36. Heads 4 of elements 37 may be provided with projections or recesses 39, to prevent the heads from rotating in relation to each other, the group of elements being inserted into a receiver 40. This receiver comprises beads 41 arranged on opposite sides, so that group 38 is secured after being inserted.

The embodiment illustrated in FIGS. 14 and 15 shows the use, according to the invention of roller-elements 42, 43 combined to form a group 44. Elements 42 comprise shafts 45 and rollers 46. Here again, use may be made of male and female connecting parts 7, 8, either in the direction shown or at 90° thereto, for the purpose of joining the roller elements together.

FIGS. 16 to 18 illustrate an embodiment of the curtain-tape in which individual slide-elements 47, 48 are not equipped, in the vertical plate at right angles to the direction of travel, with connecting parts to join them together. Instead, the division is in a horizontal plane through the direction of travel and, again, use is made of male and female connecting parts 7, 8. FIG. 17 is a plan view of a slide-element 47 with an arrangement of four female connecting parts 8 in the form of recesses arranged in a rectangle or square, so that slide-elements 47, 48 are connected together and are also secured against rotation in relation to each other. Provided in slide-elements 37 are grooves 49 through which webs 5 of elements 48 pass. This design is relatively bulky, so that a group 50 of several slide-elements 47, 48 is of some considerabe length. On the other hand, group 50 is quite low, and this design is therefore particularly suitable for very flat internal tracks 0.5 cm in height, for example. It is also possible to use slide-elements 47 only and these are then connected together by a separate connecting element similar to slide-element 48 but extending only lengthwise.

Finally, FIGS. 19 and 20 illustrate an embodiment of a curtain-tape similar to that in FIGS. 1 to 3. In this case, however, male and female connecting parts 7, 8 are arranged not only in a straight line, but after the manner of a square, with individual slide-elements 51 each comprising, in the vicinity of head 4, an opening 52 with a pyramid-shaped collar 53 having peripheral male and female connecting parts. These parts have undercuts, so that slide-elements 51 can be snapped together to form a group 54 containing any desired number of elements.

The embodiment according to FIGS. 21 and 22 illustrates a curtain-tape in which slide-elements 55 can be connected together or disconnected by means of a bayonet-type fastener. Arranged on the front side of each slide-element is a mushroom shaped cam 56 at an angle of 45°. Located on the back of head 4 is a corresponding elongated opening 57 arranged in a vertical plane, i.e. rotated through 45° in relation to cam 56. Located behind opening 27 is a recess 58 connected thereto. It is thus possible, with this design, to set two slide-elements 55 together at an angle of 45° in such a manner that cam 56 can pass through opening 57. Thereafter, slide-elements 55 are rotated through 45° to each other, so that the bayont fastener is closed. There is no difficulty in carrying out this sliding-rotating movement, since the slide-elements have sufficient freedom of movement in the curtain-tape and thus on the curtain. A design of this kind is particularly well adapted to ensure that slide-elements 55 cannot be inadvertently disconnected when tension is applied to the curtain, as is the case when curtains are drawn together. Under these circumstances, if slide-elements 55 were to become disconnected, the pleats would also be eliminated, and this must not happen.

In this case, connecting web 5 comprises, adjoining the head, a thickened part 59 matching the width of the slot in the track and imparting additional strength to slide-element 55. The central part of connecting web 5 is of reduced thickness. A downwardly-open, U-shaped web 60 is formed at the transition to strip 1, so that slide-element 55 can easily be set astride the strip. This if welding is used for attachment purposes, material of the connecting web is available on both sides of strip 1. The heat of the welding process can thus cause the material of strip 1 to penetrate into the material of strip 1 from both sides, all of the materials being thus united. In the case of a U-shaped web 60 of this kind, snap-fasteners could also be provided and these would pass through the material of strip 1, in which case the joint between connecting element 5 and strip 1 would be effected by pressure. Although this joint would be detachable, it would be strong and adequate for secondary purposes. As a rule, however, this joint would be permanent, produced either by welding or gluing.

The embodiment illustrated in FIGS. 23 to 25 uses a plug-in connection to join slide-elements 61 together.

This involves a pure sliding motion in a vertical plane at right angles to the direction of the pull applied to the curtain-tape and slide-elements 61 when the curtains are drawn. The front surface of head 4 carries a lug 62. Arranged on the rear side of head 4 is a corresponding open recess 63 with a constriction 44 in the edge-area. Here again, recess 63 is connected to a recess 65. The design of connecting web 5 is as in FIGS. 21 and 22. The latter design makes it a very simple matter to bunch slide-elements 61 together to form a group of slide-elements.

The embodiments of the invention in which an exclusive property or privilege is claimed are defined as follows:

1. A curtain-tape for hanging a curtain and forming fan-pleats, comprising: a tape sewn along one edge of a curtain; elements fixedly secured to said tape at predetermined intervals and connected together so that each element forms a fan-pleat; said elements comprising slides divided into individual slide elements, said slide elements being connected together to form a fan-pleat and into a group of slide elements; varying numbers of said elements being interconnectable according to a selected number of fan-pleats to form said group of elements, said elements having interlocking means for connecting said elements directly together.

2. A curtain-tape according to claim 1, wherein said slide elements are fixedly secured to the tape and are placed in uniform alignment, said tape comprising preformed fold-locations associated with said slide elements.

3. A curtain-tape according to claim 1, wherein said slide elements comprise a head extending at right angles to the plane of a curtain track; a connecting web extending substantially in said plane for securing the tape; and male and female connecting parts at said head for connecting said slide elements into a group of slide elements.

4. A curtain-tape according to claim 3, wherein said male and female connecting parts are made point-symmetrical.

5. A curtain-tape according to claim 3, wherein said male and female conneting parts at said head of each slide element are arranged in a vertical plane.

6. A curtain-tape according to claim 4, wherein said male and female connecting parts at said head comprise a linear groove and a linear rib.

7. A curtain-tape according to claim 6, wherein said linear groove and said linear rib are arranged in two intersecting straight lines.

8. A curtain-tape according to claim 3, wherein connections between said slide elements are detachable.

9. A curtain-tape for hanging a curtain and forming fan-pleats, comprising: a tape sewn along one edge of a curtain; elements fixedly secured to said tape at predetermined intervals and connected together so that each element forms a fan-pleat; said elements comprising rollers divided into individual roller elements, said roller elements being connnected together to form a fan-pleat and into a group of roller elements; varying numbers of said elements being interconnectable according to a selected number of fan-pleats to form thereby said group of elements, said elements having a means for connecting said elements directly together.

10. A curtain-tape according to claim 3, wherein said male and female connecting parts are made line symmetrical.

11. A curtain-tape according to claim 1, wherein said predetermined intervals are alternating intervals.

12. A curtain-tape according to claim 1, wherein connections between said slide elements are detachable.

13. A curtain-tape for hanging a curtain and forming fan-pleats, comprising: a tape sewn along one edge of a curtain; elements fixedly secured to said tape at predetermined intervals and connected together so that each element forms a fan-pleats; said elements comprising slides divided into individual slide elements, said slide elements being connected together to form a fan-pleat and into a group of slide elements; varying numbers of said elements being interconnectable according to a selected number of fan-pleats to form thereby said group of elements, said elements having interlocking means for connecting said elements directly together; said slide elements being fixedly secured to the tape and being placed in uniform alignment, said tape comprising preformed fold-locations associated with said slide elements; said slide elements comprising a further a head extending at right angles to the direction of a curtain track, a connecting web extending substantially in said direction for securing the tape, and male and female connecting parts at said head for connecting said slide elements into a group of slide elements; said male and female connecting parts being made point-symmetrical; said male and female connecting parts at said head of each slide element being arranged in a vertical plane at right angles to direction of travel; said male and female connecting parts at said head comprising further a linear groove and a linear rib; said linear groove and said linear rib being arranged in two straight intersecting lines; separate connecting elements being disconnected from the tape and uniting the slide elements; connections between said slide elements being detachable.

* * * * *